US005546709A

United States Patent [19]

Decker et al.

[11] Patent Number: 5,546,709

[45] Date of Patent: Aug. 20, 1996

[54] PORTABLE PERFORMANCE PLATFORM WITH RAIN EXCLUSION MEANS AND HYDRAULIC ACTUATOR

[75] Inventors: Matthew J. Decker, Owatonna; Todd C. Eustice, New Richland; Douglas Rau, Owatonna; Arie Boers, Plymouth, all of Minn.

[73] Assignee: Wenger Corporation, Owatonna, Minn.

[21] Appl. No.: 283,702

[22] Filed: Aug. 1, 1994

[51] Int. Cl.[6] ..... E04B 7/16

[52] U.S. Cl. ..... 52/66

[58] Field of Search ..... 52/66, 115, 126.1, 52/126.5, 6, 7

[56] References Cited

U.S. PATENT DOCUMENTS

| | | |
|---|---|---|
| 2,155,876 | 4/1939 | Stout . |
| 3,181,203 | 2/1961 | Wenger . |
| 3,258,884 | 7/1966 | Wenger . |
| 3,417,518 | 6/1966 | Jaffe . |
| 3,620,564 | 11/1971 | Wenger et al. . |
| 3,866,365 | 2/1975 | Honigman . |
| 4,232,488 | 11/1980 | Hanley . |
| 5,078,442 | 7/1992 | Rau et al. . |

FOREIGN PATENT DOCUMENTS

| | | |
|---|---|---|
| 1-197139 | 8/1989 | Japan . |

OTHER PUBLICATIONS

Wenger, The Great Outdoors, 1988, Brochure.

*Primary Examiner*—Carl D. Friedman
*Assistant Examiner*—Yvonne Horton-Richardson
*Attorney, Agent, or Firm*—Patterson & Keough, P.A.

[57] ABSTRACT

An improved portable platform for the performing arts for providing a generally covered performing stage and being shiftable from a stowed configuration to a performing configuration wherein an upper and a lower roof assembly from a canopy over the stage having a rain exclusion means for preventing the passage of rain through the canopy and for preventing the entry of rain into the platform when in the stowed configuration. The portable platform includes hydraulic actuation means having at least two hydraulic loops, the first of such loops including a hydraulic ram, the ram extending and supporting the roof assembly, the two hydraulic loops being connected by an interrupter adapted to hydraulically isolate the two loops, thereby hydraulically locking the ram to support the roof assembly in the event of a loss of hydraulic pressure in the second hydraulic loop.

9 Claims, 7 Drawing Sheets

10
88
50
14
52
48
59
58
54
56
68
64
60
38
168
16
150
162
160
36
26
62
63
152
158
166
156
154
164
29
28
28
34

18
68
68
60
60
158
158
154
154
194
193
192
192
193
182
190
180
188
178
176
M
174
170
172

PORTABLE PERFORMANCE PLATFORM WITH RAIN EXCLUSION MEANS AND HYDRAULIC ACTUATOR

FIELD OF THE INVENTION

This invention relates to performance platforms that are mobile devices suitable for transportation along roads and highways. In particular, the invention pertains to an improved portable performance platform for the performing arts that, in its stowed configuration, can be transported along roads and highways by an automobile or truck, and which can be unfolded when it reaches its destination to present an extended performance area having an overhead canopy, with improved weather protection when folded or unfolded, a consolidated and improved hydraulic lifting mechanism for folding and unfolding, and having an isolator that hydraulically locks the roof assembly in the performing configuration.

BACKGROUND OF THE INVENTION

Portable performance stages that can be transported over highways from one performance to another are known. U.S. Pat. No. 3,620,564 owned by the assignee of this application discloses a self-propelled portable stage. U.S. Pat. No. Re. 34,468 issued to Rau et al., also owned by the assignee of this application, discloses a portable performance platform, including a chassis mounted on ground engaging wheels configured for towing behind an automobile or truck. The portable performance platform has a folded stowed configuration for transportation along roads and highways and an unfolded configuration presenting an extended performing stage area having an overhead canopy. The overhead canopy is formed from a side wall and a top wall elevated from the stowed configuration by a set of at least four hydraulic piston and cylinder assemblies. A stage extending apron is lowered by a third set of two piston and cylinder assemblies. Rau teaches raising the canopy through the use of the plurality of independent hydraulic pistons and cylinders and mechanically locking the articulating arms in place with locking pins inserted through aligned holes.

Anytime pistons and cylinders are used, there is a danger of hydraulic failure. Such an occurrence with the pistons supporting the upper roof panel of the Rau device in its lifted position would permit the upper roof panel to swing back down endangering anyone standing on or in front of the stage. The canopy, formed of the upper and lower roof panels, is made safe and secure with mechanical locking pins. A design that would guard against hydraulic failure without the requirement for mechanical locking pins would greatly assist setup and takedown of the canopy.

Additionally, a portable performance platform such as the Rau device should be secure from the weather in both the stowed configuration and the extended performing configuration. A design that would prevent the entry of rain into the stage area, either by flowing into or being blown into the joint between upper and lower roof panels, would enhance the use of the platform.

A portable performance platform that is capable of supporting an over head canopy from the far side, or back, wall which is capable of controlling rain falling onto the canopy would be desirable. Additionally, a portable performance platform with a canopy safely positionable in a variety of angles and elevations and hydraulically locked in the performance configuration without the use of mechanical pins would also be desirable.

SUMMARY OF THE INVENTION

The present invention to a substantial degree satisfies the aforementioned needed improvements in the existing portable performing platforms. A multiple panel roof assembly that comprises a top wall and sidewall when in the stowed position is employed. The hydraulic system that actuates the ram that erects the roof assembly is capable of stopping at any position to give a wide variety of configurations for performing. The hydraulic system hydraulically locks the ram in the desired position, thereby minimizing the possibility the raised roof assembly could inadvertently retract, without the use of mechanical pins. Additionally, rain protection is provided along the joint between the upper and lower roof panels that is effective in both the performing and stowed configurations.

The invention is a portable platform for the performing arts for providing a generally covered performing stage that comprises a chassis that has upright supports coupled to the chassis. The upright supports are coupled to the chassis along a first side margin thereof. An articulated roof assembly is operably coupled to the supports and includes a lower roof assembly that is pivotally coupled to the supports and an upper roof assembly that is pivotally coupled to the lower roof assembly.

The present invention is an improved portable platform for the performing arts for providing a generally covered performing stage that is shiftable from a stowed configuration to a performing configuration wherein an upper and a lower roof assembly form a canopy over the stage having a rain exclusion means for preventing the passage of rain through the canopy and for preventing the entry of rain into the platform when in the stowed configuration. Additionally, the invention includes a hydraulic actuation system, including at least two hydraulic loops. The first of such loops includes a hydraulic ram, the ram extending and supporting the roof assembly. The two hydraulic loops are connected by an interrupter adapted to hydraulically isolate the two loops, thereby hydraulically locking the ram to support the roof assembly in the event of a loss of hydraulic pressure in the second hydraulic loop.

DETAILED DESCRIPTION OF THE DRAWINGS

Figure 1:
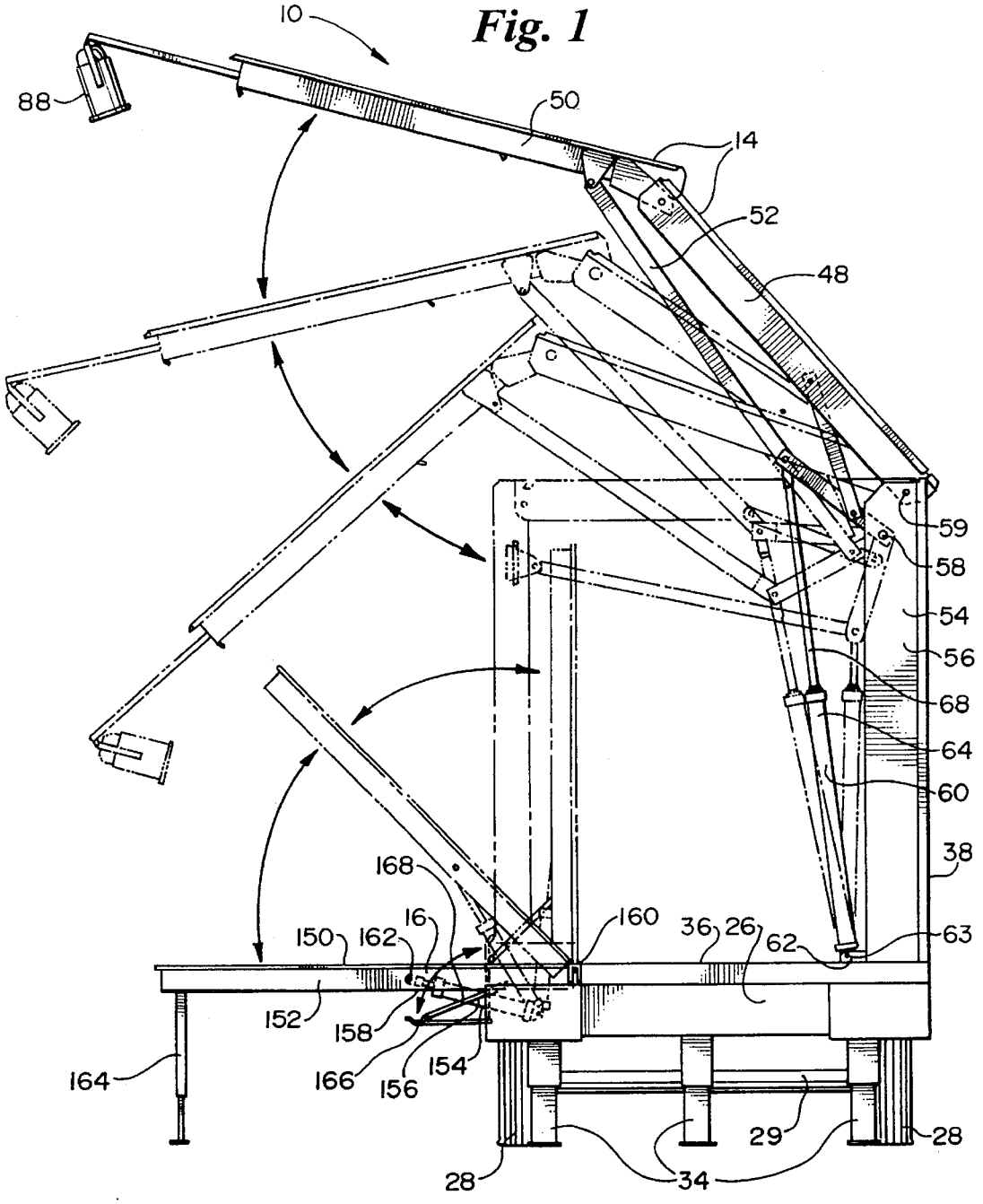
FIG. 1 is a side elevational view of the portable performance platform in accordance with the present invention depicted in the performing configuration, with the stowed configuration and intermediate positions presented in phantom.
Figure 2:
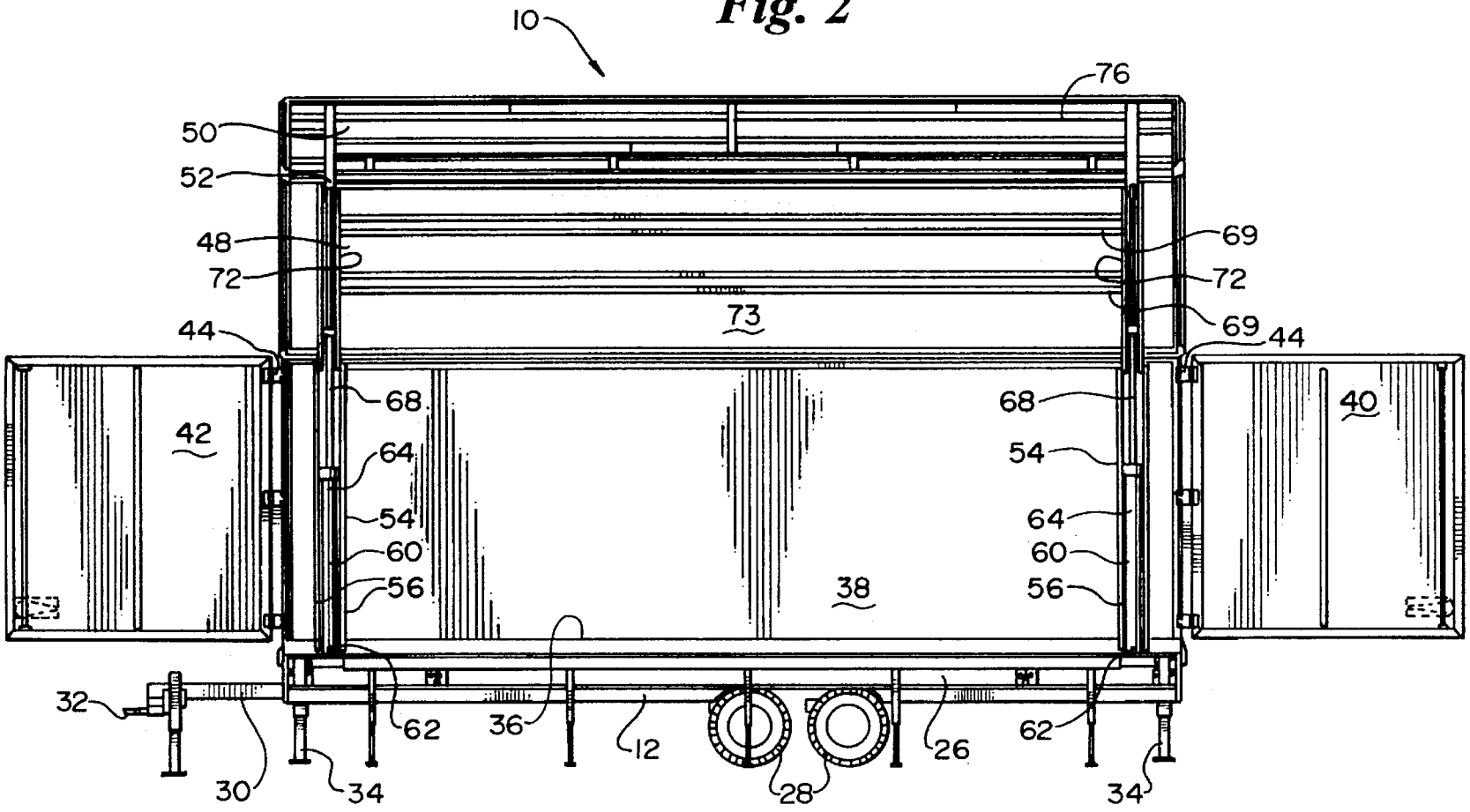
FIG. 2 is a front elevational view of the portable performance platform depicted in the performing configuration.

A portable performance platform made according to the present invention is shown generally at 10 in FIGS. 1 and 2. The portable performance platform 10 has major subgroups comprising chassis 12, roof assembly 14, apron assembly 16 and hydraulic system 18. The portable performance platform 10 is shiftable between a folded, towable, stowed configuration for transport, and an erect performing configuration for use as a stage.

The chassis 12 of portable performance platform 10 has a frame 26. The frame 26 may be referred to as a ladder-type frame, having a major structural member along either side of chassis 12 and a plurality of cross members spanning the distance between the two side structural members. Transport wheels 28 are connected via a suspension system that includes axles 29. A tongue 30 and hitch 32 are connected to chassis 12 to facilitate towing by a powered vehicle (not shown).

Extension feet 34 are lowerable from chassis 12 when portable performance platform 10 is in the performance configuration. Extension feet 34 stabilize and level portable performance platform 10. Extension feet 34 are typically retracted to a transport position that is not in contact with the ground when portable performance platform 10 is in the stowed configuration.

Stage 36 is affixed to the upper side of frame 26 of chassis 12. A vertical back wall 38 is provided at one side margin of frame 26. Stage left panel door 40 and stage right panel door 42 are shiftably connected to back wall 38 by hinges 44. When portable performance platform 10 is in the stowed configuration, stage left panel door 40 and stage right panel door 42 form the rear and front portions respectively of the enclosed portable performance platform 10.

The roof assembly 14 is comprised of four major subcomponents, lower roof assembly 48, upper roof assembly 50, linkage assembly 52, and a pair of upright standards 54. The standards 54 are made of a rectangular-shaped steel tubing. The standard 54 is structurally tied into frame 26 of chassis 12 in order to distribute the weight of roof assembly 14 across chassis 12.

A base pin hole 58 that is bored through both side members of standard 54 is provided for rotatably affixing linkage assembly 52 to standard 54. A main roof hinge pin hole 59 that is bored through both side members of standard 54 is provided for rotatably connecting the roof assembly 14 to standard 54.

An elevation ram 60 is associated with each of the two standards 54. Elevation ram 60 is a fluidly actuated device that is preferably actuated by hydraulic pressure developed by hydraulic system 18. Elevation ram 60 is rotatably connected to base bracket 62 by a pin 63. Base bracket 62 is affixed to standard 54 as by weldments. The bottom of bracket 62 is preferably flush with the stage 36.

Elevation ram 60 has a piston housing 64 and an extensible ram 68. Extensible ram 68 is connected to a piston (not shown) housed within piston housing 64. The piston is preferably of the type that has fluid pressure on both sides of the piston. Accordingly, the piston must be powered to the extended position for the performance configuration and powered to the retracted position for the stowed configuration.

The lower roof assembly 48 of the roof assembly 14 is best viewed in FIGS. 1 and 2. The lower roof assembly 48 includes cross channel supports 69 that extend widthwise across the lower roof assembly 48. The cross channel supports 69 are structurally tied into channel supports 72. Both the cross channel supports 69 and the channel supports 72 are rectangular steel tubing, which provides suitable strength for a relatively light component weight. The channel support 72 has a main roof hinge pin hole 71 bored therein that is designed to be brought into registry with the main roof hinge pin hole 59 of standard 54.

Figure 4:
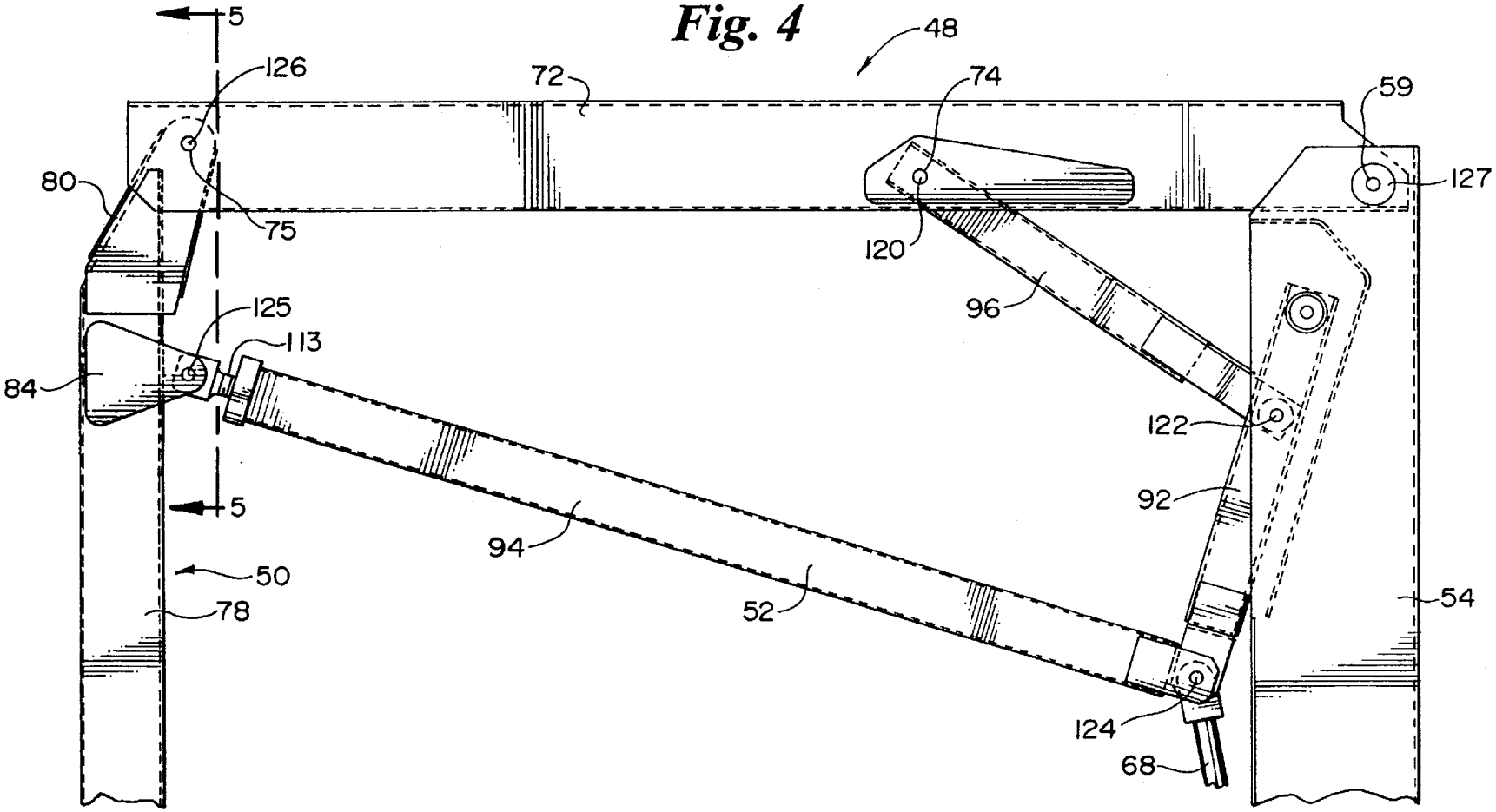
FIG. 4 is a fragmentary, side perspective view of the linkage assembly depicted in the stowed configuration.

The channel support 72 has two additional bores therein for connecting to the linkage assembly 52. The bores are the interlink pin hole 74 and the hinge pin hole 75. The bores of the interlink pin hole 74 and the hinge pin hole 75 carry through both side portions of the channel support 72, as depicted in FIG. 4.

The lower roof assembly 48 has a lower roof segment 73 that overlies the frame formed by the cross channel supports 69 and the channel supports 72. The lower roof segment 73 is formed of a relatively light material that affords protection from the elements. The lower roof segment 73 comprises the top portion of the portable performance platform 10 when the portable performance platform 10 is in the stowed position.

The upper roof assembly 50 of the roof assembly 14 is best viewed in FIGS. 1 and 2. The upper roof assembly 50 is formed in a manner that is similar to the lower roof assembly 48 and includes cross channel supports 76 that extend widthwise across the upper roof assembly 50. The cross channel supports 76 are tied into box supports 78. Both the cross channel supports 76 and the box supports 78 are preferably formed of cold formed steel.

The box support 78 has two opposed hinge plates 80 affixed thereto as by weldments. Each hinge plate 80 has a bore therethrough that comprises the hinge pin hole 82 and is designed to be brought into registry with the hinge pin holes 75 formed in channel support 72, as depicted in FIG. 4. The box support 78 additionally has two opposed ears 84 affixed thereto as by weldments. Each ear 84 has a bore therethrough that comprises the ear pin hole 86 and is designed for connection to the linkage system 52, as will be detailed.

The upper roof assembly 50 has a upper roof segment 79 that overlies the frame formed by the cross channel supports 76 and the box supports 78. The upper roof segment 79 is formed of a relatively light material that affords protection from the elements. The upper roof segment 79 comprises a side portion of the portable performance platform 10 when the portable performance platform 10 is in the stowed position. Extensible stage lights 88 may be included in the outer margin of the upper roof assembly 50.

The linkage assembly 52 has three major links; the prime link 92, the long link 94, and the interlink 96. Linkage assembly 52 is best viewed in FIGS. 1,3 and, 4.

The prime link 92 of linkage assembly 52 is comprised of a rectangular metallic tube 100 and clevis 102 at one end thereof. Prime link 92 has a series of three pin holes bored therein for receiving various linking pins. These pin holes are ram pin holes 104 formed in clevis 102 and prime pin hole 106 and base pin hole 108 formed in the tube 100 portion of prime link 92.

Long link 94 of linkage assembly 52 is comprised of an elongated rectangular tube 110. A clevis 112 is formed at one end of tube 110. At the other end of tube 110, threaded extension 113 is threaded into the longitudinal axis of tube 110. The connector block 114 is attached to threaded extension 113. Rotation of threaded extension 113 provides for adjustment of the total length of long link 94. Connection of long link 94 to linkage assembly 52 is provided by ram pin hole 115 formed in clevis 112 and ear pin hole 116 formed in connector block 114.

The third link of linkage assembly 52 is interlink 96. Like prime link 92, interlink 96 is comprised of an elongated metallic rectangular tube 117 with a clevis 118 at one end thereof. Two connecting pin holes are included. Prime pin hole 119 is bored in the-two arms of clevis 118 and interlink pin hole 120 is bored in the second end of tube 117.

Figure 3:
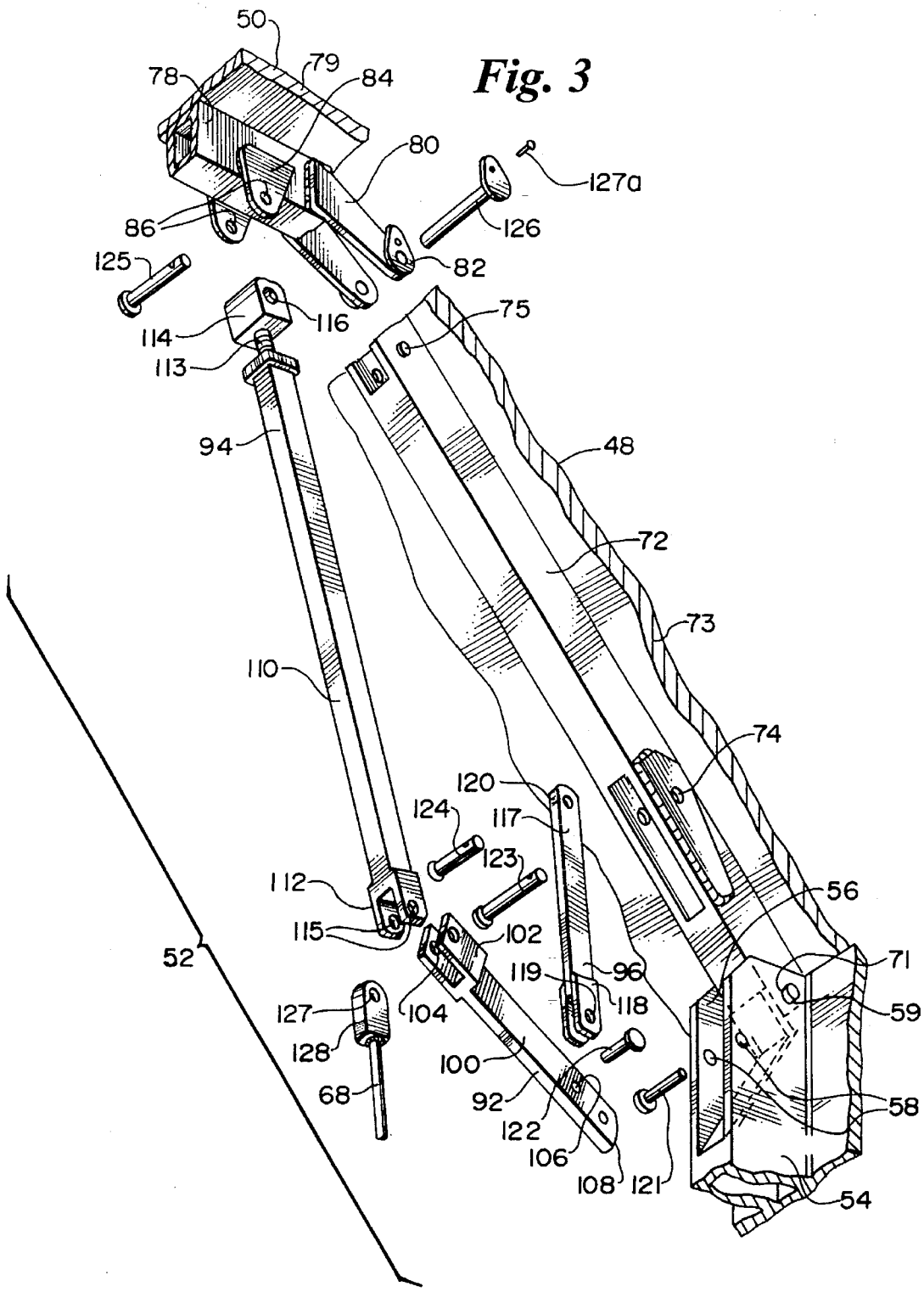
FIG. 3 is an exploded perspective view of the linkage assembly coupling the canopy panels.
Figure 5:
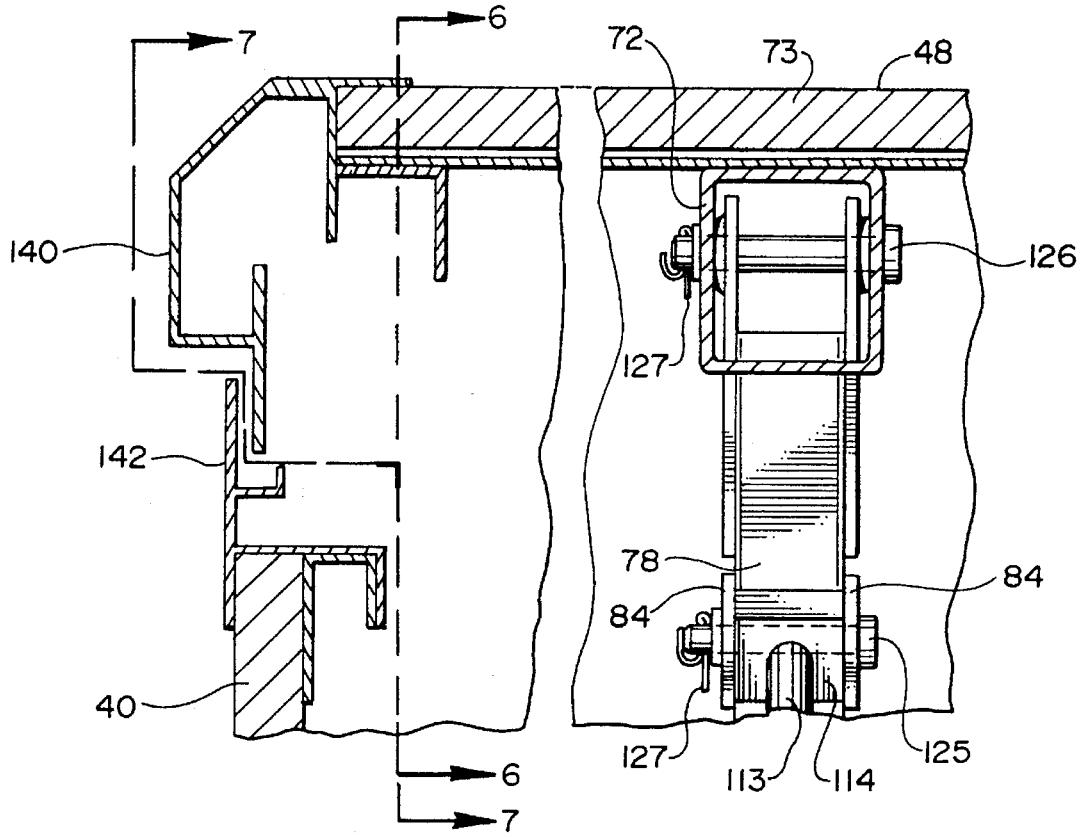
FIG. 5 is a fragmentary, sectional view depicting the side mounted interleaving weather protection devices mounted on the side margin of the upper roof panel assembly and on the stage doors, with the performance platform in the stowed configuration.

Linkage assembly 52 is held in the assembled condition by six connector pins. These pins are the prime link base pin 121, the prime-interlink pin 122, the channel pin 123, the ram pin 124, the ear pin 125, and the upper hinge pin 126. Referring to FIG. 3, upper hinge pin 126 has an oblong shaped head with a small bore therethrough. A pin 127*a* is inserted through this hole and a corresponding hole proximate hinge pin hole 82 to hold the pin 127 in place. Alternatively, a cotter pin 127, as is depicted in FIG. 5, could be used to prevent the pin 126 from coming adrift.

In assembly, the end of prime link 92 is inserted between the side members of standard 54. Prime link base pin 121 is then inserted through base pin hole 58 bored in standard 54 and through base pin hole 108 bored in prime link 92. The clevis 118 of interlink 96 is placed over the tube 100 of prime link 92. Prime-interlink pin 122 is inserted through prime pin hole 119 and interlink 96 and through prime pin hole 106 bored in prime link 92, thereby interconnecting prime link 92 and interlink 96. The second end of interlink 96 is inserted between the side members of channel support 72 of lower roof assembly 48. Channel pin 123 is then inserted into interlink pin hole 74 bored in channel support 72 and through interlink pin hole 120 bored in interlink 96, thereby joining interlink 96 to channel support 72.

A three-way joint is formed with prime link 92, long link 94, and ram 68. The head 128 of ram 68 is placed within clevis 112 of long link 94. Clevis 102 of prime link 92 is placed outside the clevis 112 of long link 94. Ram pin 124 is then inserted through an engaging hole 127 of ram head 128, ram pin hole 115 of long link 94 and ram pin hole 104 of prime link 92. The connector block 114 of long link 94 is then inserted between ears 84 affixed to the side of square support 78. Ear pin 125 is then inserted into ear pin holes 86 and through ear pin hole 116 bored in connector block 114, thus connecting long link 94 to upper roof assembly 50.

The hinge pin holes 82 formed in hinge plate 80 are brought into registry with the hinge pin holes 75 bored in channel support 72 and inserting upper hinge pin 126 therethrough. This action articulatingly couples the upper roof assembly 50 to the lower roof assembly 48. The linkage assembly 52 is depicted assembled with standard 54, channel support 72, and rectangular support 78 in FIG. 4. FIG. 4 depicts the lower roof assembly 48 and the upper roof assembly 50 in their stowed configuration.

FIGS. 5–8 depict measures taken to ensure the water tight integrity of the portable performance platform 10 when in both the stowed configuration and the performance configuration. FIG. 5 depicts the upper and lower side weather shields 140, 142. The weather shields 140, 142 are intended to minimize the intrusion of water into the interior space of portable performance platform 10 when portable performance platform 10 is in the stowed position.

The upper side weather shield 140 is affixed to the side margin of lower roof segment 73 and depends therefrom when in the stowed configuration. The lower side weather shield 142 is affixed to the upper margin of stage left panel door 40. The corresponding lower side weather shield 142 is similarly affixed to stage right panel door 42. The lower side weather shields 142 extend the full width of doors 40, 42. A portion of lower side weather shield 142 is interleaved with a portion of upper side weather shield 140. By positioning the lower side weather shield 142 exterior to upper side weather shield 140, the stage doors 40, 42 may be opened while roof assembly 14 is in the stowed position. The overlapping portions of lower side weather shield 142 and upper side weather shield 140 are positioned beneath an overhanging portion of upper side weather shield 140. Such design encourages rain to flow off of upper side weather shield 140 without dripping onto lower side weather shield 142. It should be noted that upper side weather shield 140 extends the full width of lower roof assembly 48 when lower roof assembly 48 is in the stowed configuration. Likewise, lower side weather shield 142 extends the full width of the stage door 40, 42.

Figure 6:
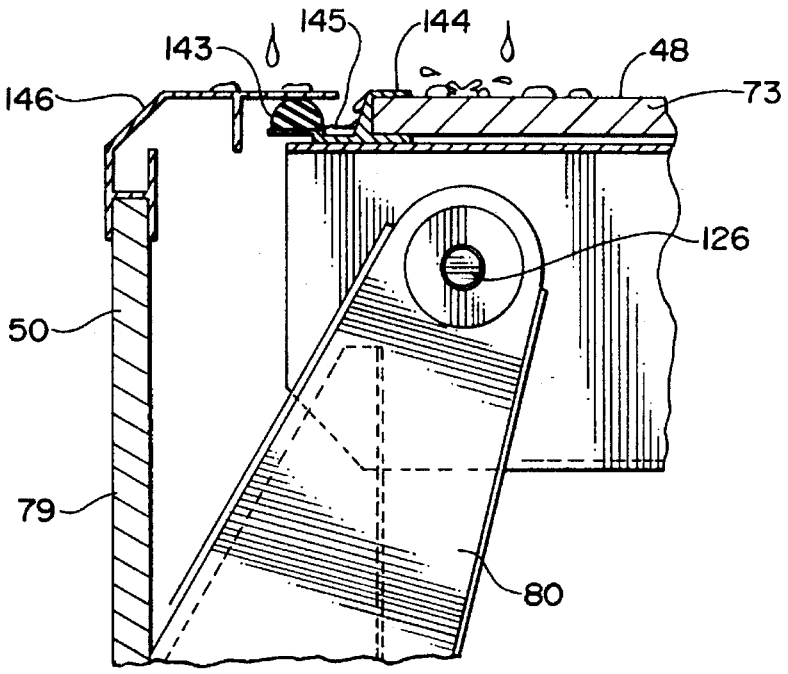
FIG. 6 is a sectional view taken along the line 6—6 of FIG. 5.
Figure 7:
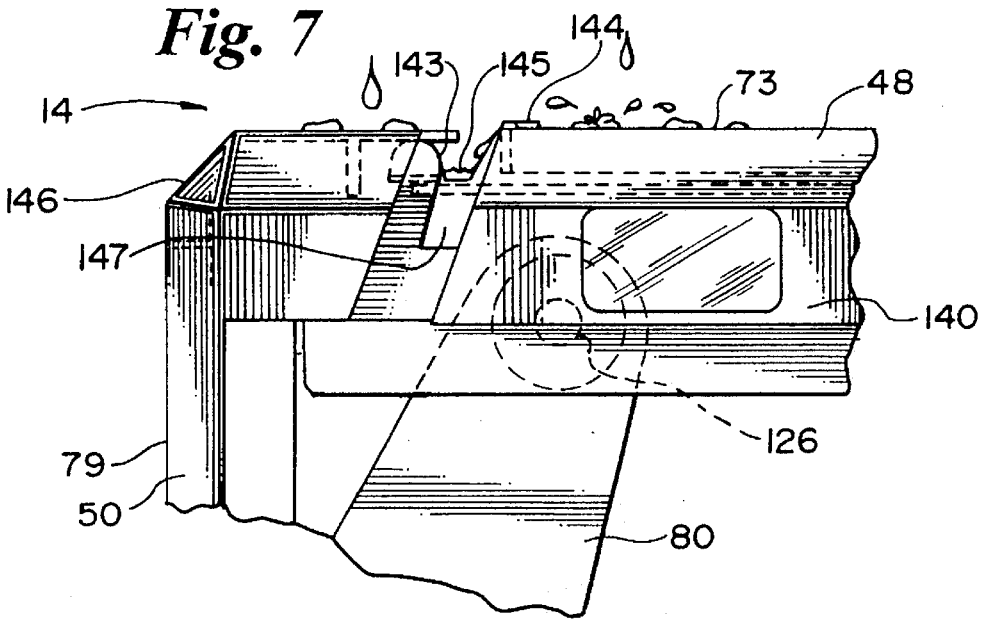
FIG. 7 is a sectional view taken along the line 7—7 of FIG. 5.

FIG. 6 depicts certain components as they are oriented when the roof assembly 14 is in the stowed configuration. A weather seal 143, extruded of an elastomeric material, is disposed across the full width of lower roof assembly 48. Weather seal 143 is fastened to a portion of bracket 144. Bracket 144 is preferably made of extruded aluminum and is bonded to lower roof segment 73. Bracket 144 and weather seal 143 act cooperatively to form gutter 145.

The generally L-shaped weather shroud 146 is affixed to upper roof segment 79 of upper roof assembly 50. Weather shroud 146 is preferably made of extruded aluminum. When in the stowed position, weather shroud 146 is held in compressive engagement with the upper portion of weather seal 143, thereby creating a substantially water-tight joint. Both ends of gutter 145 terminate in an inclined spillway 147 of FIG. 7. Spillway 147 is inclined outward and is intended to carry water collected in gutter 145 down the sides of upper side weather shield 140.

Figure 8:
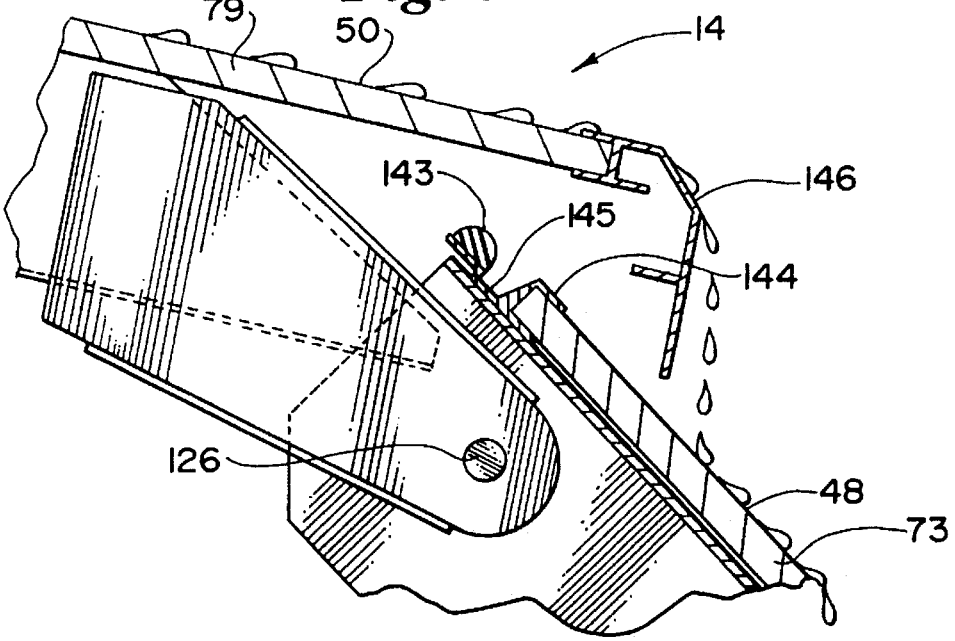
FIG. 8 is a fragmentary, sectional view of the weather protection devices presented in FIGS. 6 and 7, but with the performance platform depicted in the performance configuration.

FIG. 8 depicts roof assembly 14 in its extended performance configuration. In such configuration, weather shroud 146 overlies the joint between the lower roof assembly 48 and the upper roof assembly 50. Rain water collecting on the upper surface of upper roof panel 79 flows across weather shroud 146 and on to the upper surface of lower roof segment 73. This arrangement generates a generally weather tight seal about the exposed joint between the lower and upper roof assemblies 48, 50.

Apron assembly 16 is best depicted in FIGS. 1 and 2. Apron assembly 16 provides an extended front portion coupled to the front margin of stage 36. Apron assembly 16 has a stowed configuration that is inboard of upper roof assembly 50 when also in the stowed configuration. Apron assembly 16 has a performing configuration in which the stage 150 of apron assembly 16 is flush with the stage 36.

Stage 150 is supported by channel supports 152. Channel supports 152 are typically made of cold formed steel and comprise a ladder type frame supporting stage 150.

Apron assembly 16 is selectively positioned between a vertical stowed configuration and its horizontal performance configuration by apron ram 154. Apron ram 154 has a first end affixed to chassis 12 and a second end pivotally affixed between channel supports 152 at pin attachment 162. In order to affect translation of apron assembly 16, apron assembly 16 is hinged at pivoting attachment 160.

Apron ram 154 is comprised of a piston housing 156 that houses a moveable piston (not shown). The moveable piston is connected to ram 158. Ram 158 is extensible under hydraulic pressure applied to either side of the apron ram piston by hydraulic system 18. A plurality of auxiliary supports 164 are configured at the front end of apron assembly 16 in order to provide increased stability and leveling thereof.

A side cover 166 is connected via connector link 168 to channel support 152. When in the stowed configuration, the upper lip of side cover 166 bears upon upper roof assembly 50 creating a substantially dust tight enclosure.

Figure 9:
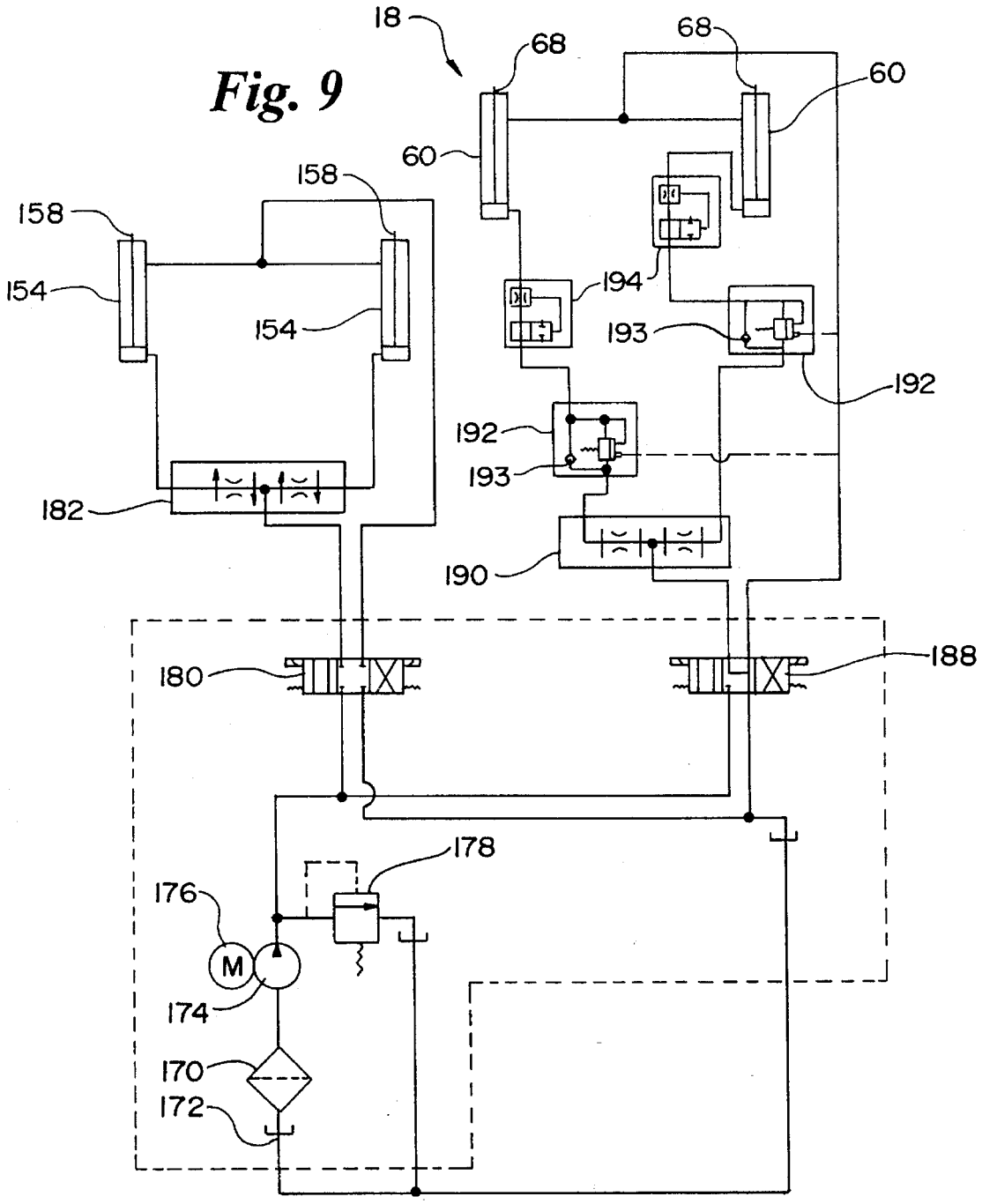
FIG. 9 is a schematic depiction of the hydraulic system.

The hydraulic system 18 is shown schematically in FIG. 9. The hydraulic system 18 controls the operation of the pair of extension rams 60 and the pair of apron rams 154. Hydraulic system 18 has an in line hydraulic filter 170. Hydraulic filter 170 has a return inlet 172 for accepting return hydraulic fluid from other components of hydraulic system 18.

Filter 170 is connected to pump 174. Pump 174 is driven by an electric motor 176. Pump 174 is a unidirectional pump, pumping in the upward direction as depicted in FIG. 9. A relief valve 178 is connected to the output of pump 174. Relief valve 178 will activate if the pressure on the output side of 174 exceeds a certain pressure. In that case, relief valve 178 will act to by-pass hydraulic fluid to the return inlet 172 of filter 170.

The output or power side of pump 174 is connected to apron valve 180. For stowing apron assembly 16, apron valve 180 is shifted to the right as depicted in FIG. 9, thereby connecting the power input of apron valve 180 to balancer 182 and connecting the return line from apron rams 154 to the return line from apron valve 180. In this configuration, the apron assembly 16 is powered to the stowed configuration, in which the ram of apron rams 154 is in the extended position.

Balancer 182 is a device that ensures that the two outputs thereof are providing equal pressure and flow to the two apron rams 154. This ensures that the two apron rams act in concert when raising the apron assembly 16 to the stowed configuration. The output of balancer 182 is ported to the lower side of the piston in apron ram 154. As the piston rises, hydraulic fluid is ported out of the ram end and returned to the return inlet 172 of filter 170.

To lower the apron assembly 16 to the performance configuration, apron valve 180 is shifted to the left. In this configuration, the power input to apron valve 180 is connected to the return line from apron rams 154. Simultaneously, the power input to apron rams 154 is connected to the return line. Accordingly, hydraulic fluid under pressure enters the top portion of apron rams 154, driving the pistons downward and expelling hydraulic fluid from the power side of the pistons through the balancer 182 to the return inlet 172 of filter 170. This action retracts the rams 158 of apron rams 154, thereby lowering the apron assembly 16 to the performance configuration.

Roof valve 188 controls the flow of hydraulic fluid from pump 174 to the two elevational rams 60. The output lines from roof valve 188 can be generally described as a power line going to balancer 190 and a return line in the upper portion of the piston of elevational ram 60. In the configuration depicted, both the power line and the return line are connected to the return output from roof valve 188 and are connected to the return input 172 of filter 170. This condition is what can be described as a hold condition in which the roof assembly 14 is held in a desired configuration by hydraulic pressure.

To power the roof assembly 14 from the stowed configuration to the performance configuration, roof valve 188 is shifted to the right as indicated in FIG. 9. In this configuration, the power input to roof valve 188 is connected to the power output of roof valve 188 and the return input to roof valve 188 is connected to the return output thereof. Hydraulic pressure from pump 174 is routed through balancer 190 to safety valves 192. Hydraulic pressure passes through check valve 193 of safety valve 192 and is sent to lockout valve 194.

Lockout valve 194 is a one way device designed to maintain pressure on the power side of pistons of the elevation ram 60 even if there is a break in a hydraulic line downstream of lockout valves 194. Accordingly, lockout valves 194 are located proximate the elevation ram 60. Hydraulic fluid under pressure entering the lower portion of elevation ram 60 acts upon the piston contained therein and extends rams 68. The extension of rams 68 elevates the roof assembly 14 to the performance configuration. Once in the performance configuration, safety valves 192 act to lock elevation rams 60 in the selected configuration. Such locking is accomplished by eliminating power from the return side of the elevation rams 60.

To retract the roof assembly to the stowed configuration, valve 188 is shifted to the left. This shifting connects the power input to roof valve 188 to the return input and connects the power output to the return output. An electrical signal to the solenoids of roof valve 188 is required to shift the valves of 188 to the left as indicated in FIG. 9, connecting the power line.

The safety valve 192 has a pressure sensitive relief valve contained therein. When the increased pressure from the pump 174 is detected in the return line, that pressure is sent to the pressure sensitive relief valve via the dashed lines interconnecting the return lines and the respective safety valves 192, thereby opening the pressure sensitive relief valve and connecting the power line.

In the aforedescribed configuration, hydraulic fluid under pressure is sent through the return line to the upper portion of the elevation rams 60. The hydraulic fluid under pressure forces the pistons in the downward direction, as depicted in FIG. 9. As the pistons move downward, hydraulic fluid is expelled from the power side of the pistons through the now opened lockout valves 194 and thence through the pressure sensitive relief valve of the safety valves 192. The hydraulic fluid then passes through balancer 190 and roof valve 188 to the return output thereof and ultimately to the return input 172 of filter 170.

In operation, shifting the portable performance platform 10 from the stowed configuration to the performance configuration is accomplished by first opening stage doors 40, 42 to the position as depicted in FIG. 2. The hydraulic system 18 is then actuated to erect the lower roof assembly 48 and upper roof assembly 50 of the roof assembly 14 from the stowed configuration to the performance configuration. The linkage assembly 52 provides that rotational motion of the lower roof assembly 48 and upper roof assembly 50 occurs simultaneously at a predetermined ratio therebetween. It should be noted that the lower roof assembly 48 is elevated through an arc of approximately fifty degrees at the same time as the upper roof assembly 50 is elevated through an arc of approximately one hundred thirty-five degrees.

As the lower roof assembly 48 is raised, the hinged point for the upper roof assembly 50 is both raised and moved to the right as indicated in FIG. 1. The effect of moving the hinged point of upper roof assembly 50 to the right is that the arc transcribed by the upper margin of upper roof assembly 50 is kept relatively close to the front margin of the stage 36 of portable performance platform 10. This minimizes the clearance required between portable performance platform 10 and obstructions to the left of portable platform 10 during the erection of the roof assembly 14, as depicted in FIG. 1.

When the roof assembly 14 is in the desired performance configuration, the hydraulic system 18 is configured to the hold configuration as indicated in FIG. 9. In this configuration, safety valves 192 are held by the integral check valve. Accordingly, the lockout valves 194 and safety valves 193 provide for two locking devices for each elevation ram 60 to prevent the loss of hydraulic pressure in the event of the rupture of a hydraulic line downstream from safety valves 192. Accordingly, the elevation rams 60 are hydraulically locked in place.

After erection of roof assembly 14 to the performance configuration, apron assembly 16 may be lowered from its upright stowed configuration to its horizontal performance configuration. Such lowering is accomplished by suitably activating hydraulic system 18.

Although a certain specific embodiment of the present invention has been shown and described, it is obvious that many modifications and variations thereof are possible in light of the teachings. It is to be understood therefore that within the scope of the appended claims, the invention may be practiced otherwise than as specifically described herein.

We claim:

1. An improved portable platform for the performing arts for providing a generally covered performing stage having a stage front margin, rear margin, and opposed end margins, a chassis having first and second side margins and a stage support structure extending generally between said first and second side margins, said chassis first and second side margins generally corresponding to said stage rear and front margins, a back wall carried by said upright support means along said first side margin, first and second wall panels operably, hingeably coupled to said back wall, said wall panels shiftable between a stowed configuration wherein they comprise opposed end walls and a performance configuration wherein said wall panels comprise extensions to said back wall, ground engaging wheels operably carried by the chassis for over land transportation of said chassis, upright support means operably coupled to said chassis, said upright support means comprising weight bearing standards operably coupled to said chassis along said first side margin, articulated roof assembly means for forming a canopy over the stage operably coupled to said support means including a lower roof assembly having a back margin, a front margin, and opposed side margins, pivotally coupled to said support means at said back margin, and an upper roof assembly operably, pivotally coupled to said lower roof assembly at a hinge line defined along said front margin thereof, and means for selectively shifting said roof assembly means between a stowed configuration wherein said lower roof assembly comprises a top wall and said upper roof assembly comprises a sidewall and a performing configuration wherein said lower roof assembly and upper roof assembly comprise an overhead canopy extending over said stage, the improvement comprising:

first rain exclusion means for preventing the passage of rain through the canopy at the hinge line formed between the upper roof assembly and the lower roof assembly having a first portion operably coupled to said upper roof assembly and a second portion operably coupled to said the lower roof assembly at the front margin thereof, said first and second portions of said first rain exclusion means being in cooperative sealing engagement defining a substantially water impervious seal along said hinge line when in the stowed configuration and being overlapped, defining a substantially rain impervious joint along said hinge line when in the performance configuration; and second rain exclusion means for preventing the intrusion of rain into the interior space defined within the portable platform when in the stowed configuration having a first upwardly tending portion carried by said wall panels and a second portion depending from the side margins of the lower roof assembly, being disposed outwardly of and overlapping the first portion thereof when in the stowed configuration, defining a substantially rain impervious joint along the side margins of the lower roof assembly.

2. An improved portable platform for the performing arts as claimed in claim 1, wherein the first rain exclusion means includes a compressible elastomeric seal fixedly coupled to said second portion of said first rain exclusion means, said seal being in compressive engagement with said first portion of said first rain exclusion means when in the stowed configuration.

3. An improved portable platform for the performing arts as claimed in claim 2, wherein the first rain exclusion means further includes a rain gutter defined by said second portion of said first rain exclusion means, said rain gutter extending between the side margins of the lower roof assembly and being adapted to convey accumulated rain to flow from the side margins of the lower roof assembly when in the stowed configuration.

4. An improved portable platform for the performing arts as claimed in claim 3, wherein the gutter has a generally U shape having a bottom and two sides with the compressible elastomeric seal forming one of said sides.

5. An improved portable platform for the performing arts as claimed in claim 1, wherein the first rain exclusion means defines a rain shroud having a generally L shaped cross section with a first leg of the L shaped cross section being disposed generally coplanar with the plane of the upper roof assembly and the second leg thereof extending over the hinge line and being oriented generally downward in the performing configuration, shielding the front margin of the lower roof assembly from incident rain.

6. An improved portable platform for the performing arts for providing a generally covered performing stage having a chassis having first and second side margins and a support structure extending generally between said first and second side margins, ground engaging wheels operably carried by the chassis for over land transportation of said chassis, upright support means operably coupled to said chassis, said upright support means comprising weight bearing standards operably coupled to said chassis along said first side margin, articulated roof assembly means operably coupled to said support means including a lower roof assembly, pivotally coupled to said support means and an upper roof assembly operably, pivotally coupled to said lower roof assembly, the improvement comprising:

hydraulic actuation means for selectively shifting said roof assembly means between a stowed configuration wherein said lower roof assembly comprises a top wall and said upper roof assembly comprises a sidewall and a performing configuration wherein said lower roof assembly and upper roof assembly comprise an overhead canopy extending over said chassis, said hydraulic actuation means hydraulically locking said roof assembly in a selected performing configuration.

7. An improved portable platform for the performing arts as claimed in claim 6, the hydraulic actuation means including at least one extensible ram that is extendable between a retracted configuration and an extended configuration and having at least one mechanical interrupter that interrupts the hydraulic integrity of the hydraulic actuation system to hydraulically isolate a portion of the hydraulic actuation system, thereby hydraulically locking the ram in the extended configuration.

8. An improved portable platform for the performing arts as claimed in claim 6, the hydraulic actuation means including at least two hydraulic loops, the first of such loops including a hydraulic ram, the ram extending and supporting the roof assembly, the two hydraulic loops being connected by an interrupter adapted to hydraulically isolate the two loops, thereby hydraulically locking the ram to support the roof assembly in the event of a loss of hydraulic pressure in the second hydraulic loop.

9. A portable platform for the performing arts for providing a generally covered performing stage, comprising:

a chassis having first and second side margins and a support structure extending generally between said first and second side margins;

ground engaging wheels operably carried by the chassis for over land transportation of said chassis;

upright support means operably coupled to said chassis, said upright support means comprising weight bearing standards operably coupled to said chassis along said first side margin;

articulated roof assembly means operably coupled to said support means including a lower roof assembly, pivotally coupled at a main pivot point to said support means and an upper roof assembly operably, pivotally coupled at a secondary pivot point to said lower roof assembly; and erection means for selectively shifting said roof assembly means between a stowed configuration wherein said lower roof assembly comprises a top wall and said upper roof assembly comprises a sidewall and a performing configuration wherein said lower roof assembly and upper roof assembly comprise an overhead canopy extending over said chassis, having an extensible ram that is extensible between a retracted configuration and an extended configuration, a hydraulic system operably fluidly coupled to the extensible ram, and a linkage system operably linking said extensible ram to said support means, to said lower roof assembly and to said upper roof assembly, whereby hydraulic actuation of the extensible ram acts on said linkage system to pivot the lower roof assembly about the main pivot point, thereby displacing the secondary pivot point horizontally and vertically, and to simultaneously pivot the upper roof assembly about the secondary pivot point, the hydraulic system including mechanical isolation means for isolating a portion thereof in order to hydraulically lock the ram in an extended configuration, thereby locking the roof assembly in a selected performing configuration.

* * * * *

UNITED STATES PATENT AND TRADEMARK OFFICE

CERTIFICATE OF CORRECTION

PATENT NO. : 5,546,709

DATED : August 20, 1996

INVENTOR(S) : Matthew J. Decker, et. al.

It is certified that error appears in the above-indentified patent and that said Letters Patent is hereby corrected as shown below:

Column 4, line 49, delete "a" and insert --an--.

Column 4, line 60, insert a space between "1," and "3".

Column 4, line 60, delete the comma after the word "and".

Column 5, line 15, delete the hyphen between the words "the" and "two".

Signed and Sealed this

Eleventh Day of February, 1997

Bruce Lehman

*Attest:*

BRUCE LEHMAN

*Attesting Officer*

*Commissioner of Patents and Trademarks*